US005816261A

United States Patent [19]

Dyett

[11] Patent Number: 5,816,261

[45] Date of Patent: Oct. 6, 1998

[54] CIGARETTE ROD CUTTING

[75] Inventor: Derek Henry Dyett, Bucks, England

[73] Assignee: Molins PLC, Milton Keynes, England

[21] Appl. No.: 709,736

[22] Filed: Sep. 9, 1996

[30] Foreign Application Priority Data

Sep. 14, 1995 [GB] United Kingdom ..... 9518788

[51] Int. Cl.[6] ..... A24C 5/18

[52] U.S. Cl. ..... 131/84.4; 83/310; 83/931

[58] Field of Search ..... 83/931, 310, 331, 83/451, 327; 131/46, 280, 84.1–84.4

[56] References Cited

U.S. PATENT DOCUMENTS

| | | | |
|---|---|---|---|
| 3,760,672 | 9/1973 | Labee et al. | 83/310 |
| 3,850,065 | 11/1974 | Labbe et al. | 83/310 |
| 4,534,252 | 8/1985 | Harrington et al. | 83/310 |
| 4,883,076 | 11/1989 | Belevederi | 131/84.4 |

FOREIGN PATENT DOCUMENTS

| | | | |
|---|---|---|---|
| 2 108 820 | 5/1983 | United Kingdom | 83/310 |

*Primary Examiner*—Vincent Millin
*Assistant Examiner*—Charles W. Anderson
*Attorney, Agent, or Firm*—Antonelli, Terry, Stout, & Kraus, LLP

[57] ABSTRACT

A ledger device suitable for use in a cigarette making machine, for supporting one or more cigarette rods while being cut into predetermined lengths, comprises two similar ledger support members (10; 12) mounted respectively on two pairs of cranks (30,32; 42,44) and arranged to orbit two ledger parts (22; 28) in the same plane along the same circular path, 180° out of phase with one another, each ledger part being arranged to support the rod or rods during alternate cuts.

4 Claims, 2 Drawing Sheets

CIGARETTE ROD CUTTING

This invention is concerned particularly with ledger devices for supporting a continuous cigarette rod in a cigarette making machine while the rod is being cut into sections of predetermined length. This invention is particularly, though not exclusively, concerned with cutting simultaneously two cigarette rods formed in a twin-track cigarette making machine.

Our U.S. Pat. Nos. 3,760,672 and 3,850,065 both describe rotary ledger devices comprising two rotary members rotating about parallel axes and serving as cranks to which opposite ends of a ledger support member are pivotally connected. Thus the ledger support member, and also the ledger part on it, orbit in a circular motion at a constant orientation. The ledger part supports the rod and moves momentarily with it while the rod is being cut.

The ledger devices described in our above mentioned patents are both configured so that the ledger member is approximately parallel to the rod. According to one aspect of the present invention, in a ledger device of basically the same type, the ledger support member is pivotally connected at or near one end to one of the cranks, is pivotally connected at an intermediate position between its ends to the other crank, and carries the ledger part at the other end to support a rod having its axis generally transverse to the ledger support member.

A ledger device according to another aspect of this invention comprises two similar ledger support members mounted respectively on two pairs of cranks and arranged to orbit two ledger parts in the same plane and along the same circular path, 180° out of phase with one another, each ledger part being arranged to support the rod during alternate cuts. Thus each half of the ledger device orbits at half the speed that would be required if it were to support the rod during each cut; also, the orbiting radius is double what would be required if one part of the ledger were to act on its own, and accordingly the rod is supported better while each cut is being made. The configuration may be but is not necessarily in accordance with the first aspect of this invention.

Figure 1:
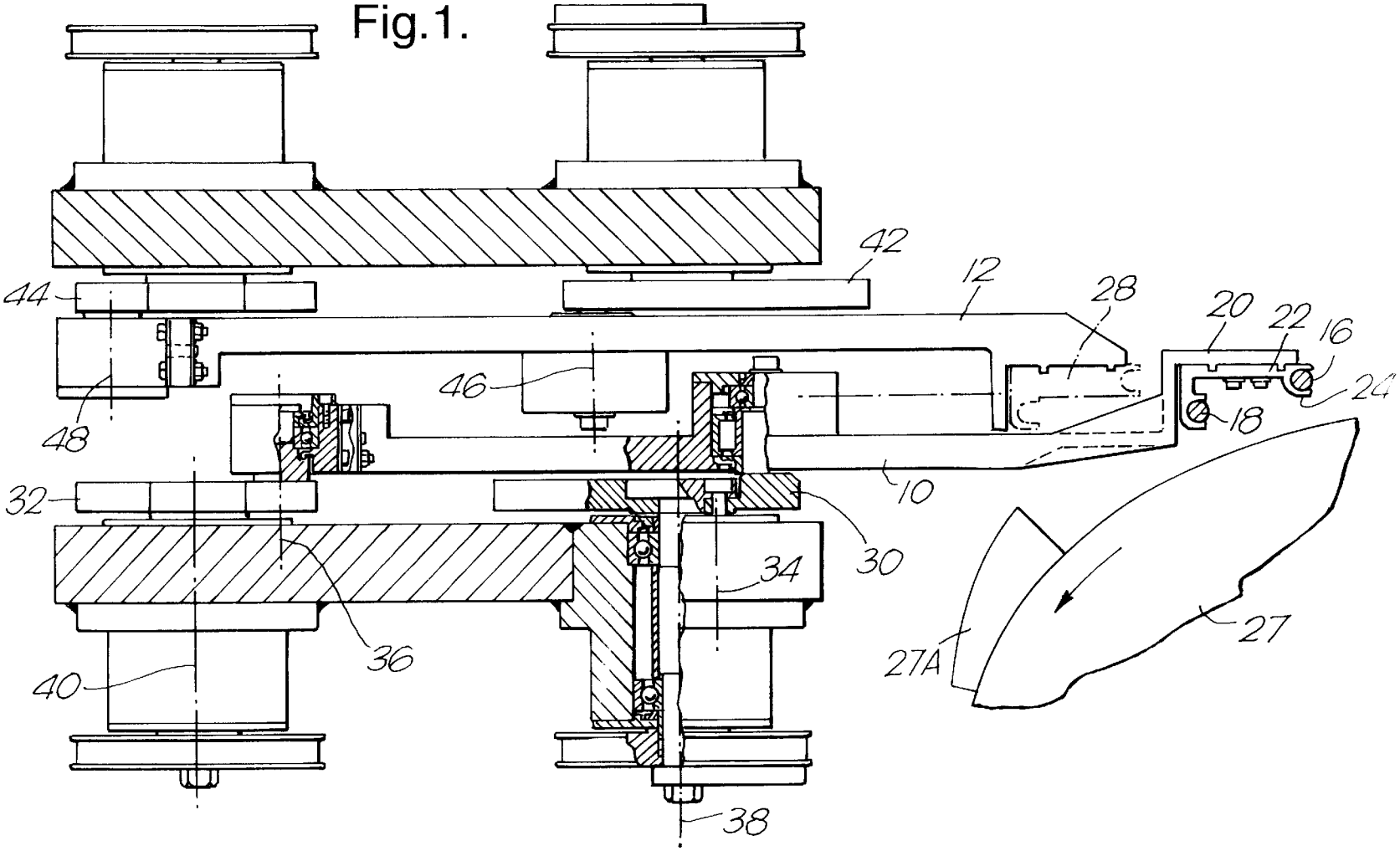
Figure 2:
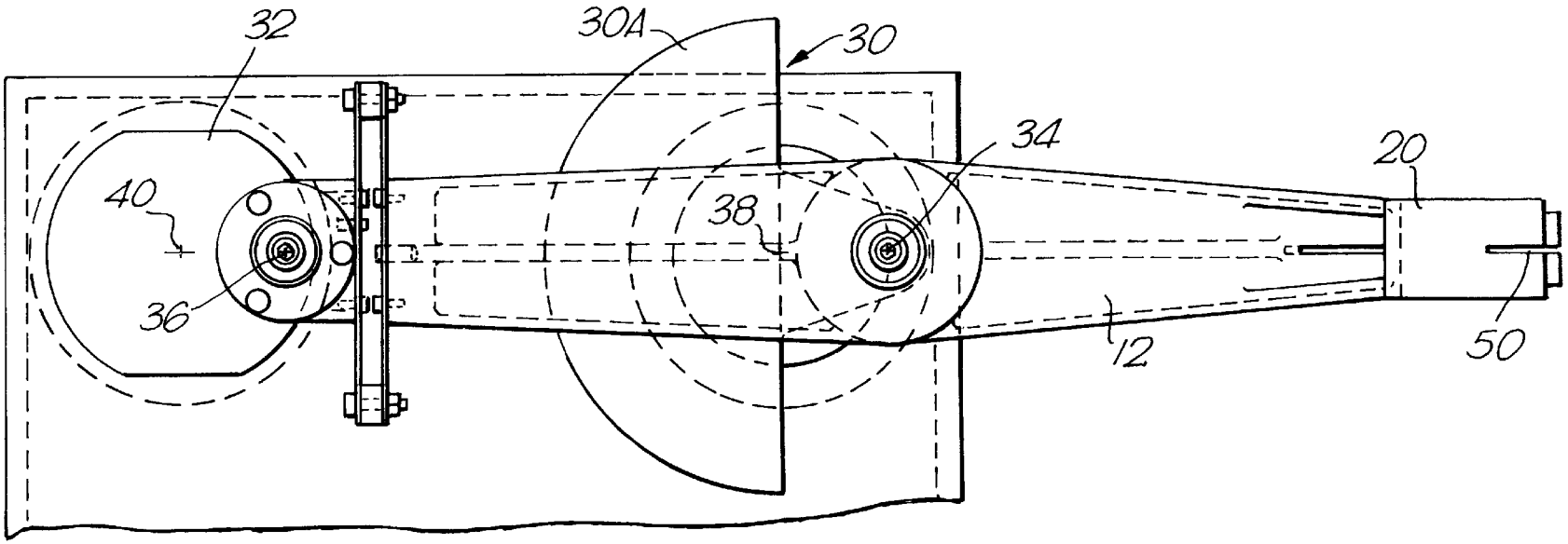

An example of a ledger device according to this invention is shown in the accompanying drawings. In these drawings:

FIG. 1 is a partly sectioned view of the ledger device, showing one of the ledger parts in engagement with two cigarette rods; and FIG. 2 is a view from the top of FIG. 1 omitting the nearer ledger part and its associated supporting and driving parts.

The ledger device shown in the drawings comprises two similar mechanisms which are mainly mirror images of one another about a plane midway between and parallel to two ledger support members 10 and 12. The plane of symmetry is shown at 14; it passes between two cigarette rods 16 and 18 and is equidistantly spaced from both rods.

As the two halves of the ledger device are substantially identical, the following description relates to only one half, namely that including the ledger support member 10.

At the right-hand end of the ledger support member 10, an offset portion 20 is provided to carry a ledger part 22 formed with grooved portions 24 and 26, the part 22 being secured to the portion 20 by screws or other devices (not shown). Each of the grooved portions 24 and 26 is shown in the position in which it engages the left side of each of the rods 16 and 18 so as to support the rods while they are being cut by a rotary member 27 which carries at least one knife 27A. The grooved portions 24 and 26 act in this way while the corresponding ledger support member 10 is in the "top dead centre position". At this stage, a generally similar grooved ledger part 28 on the ledger support member 12 is in its position furthest away from the rods; ie, is at "bottom dead centre".

It should be noted that the ledger parts 22 and 28 are generally similar (though not identical) and are similarly orientated, rather than being mirror images of one another. This necessitates differences in the shape of the right end portion of the ledger support member 12, when compared with the ledger support member 10, these differences being self-evident and not calling for any particular comment.

The ledger support member 10 is pivotally mounted on rotary crank members 30 and 32 about axes 34 and 36. The members 30 and 32 rotate about axes 38 and 40, and it should be noted that the corresponding rotary members 42 and 44 of the other half of the ledger rotate about the same axes 38 and 40. In the position shown in FIG. 1, the pivot axes by which the ledger support member 12 is connected to the rotary members 42 and 44 are shown at positions 46 and 48.

As shown in FIG. 2, the rotary member 30 is formed with a balance weight 30A in order to minimise vibration during use; the rotary member 32 may also carry or be formed with a balance weight. Also as shown in FIG. 2, the end portion 20 of the ledger support member 10 is formed with a slot 50 through which the cut-off knife passes during each cutting stroke. The slot also extends through the part 22 to the extent necessary to allow the knife to pass through while cutting the rods.

FIG. 1 shows the rods 16 and 18 at different levels. The level difference may be increased, in which the plane of symmetry 14 of the ledger would be appropriately inclined to the horizontal.

I claim:

1. A ledger device suitable for use in a cigarette making machine, for supporting one or more continuous cigarette rods while being cut into predetermined lengths, comprising two rotary members rotating about parallel axes and serving as cranks to which opposite ends of a ledger support member are pivotally connected, characterised in that the ledger support member is pivotally connected at or near one end to one of the cranks, is pivotally connected at an intermediate position between its ends to the other crank, and carries a ledger part at the other end to support a rod having its axis generally transverse to the ledger support member.

2. A ledger device in accordance with claim 1, comprising two similar ledger support members mounted respectively on two pairs of cranks and arranged to orbit two ledger parts in the same plane along the same circular path, 180° out of phase with one another, each ledger part being arranged to support the rod or rods during alternate cuts.

3. A ledger device suitable for use in a cigarette making machine, for supporting one or more cigarette rods while being cut into predetermined lengths, comprising two similar ledger support members mounted respectively on two pairs of cranks and arranged to orbit two ledger parts in the same plane along the same circular path, 180° out of phase with one another, each ledger part being arranged to support the rod or rods during alternate cuts.

4. A ledger device according to claim 3, suitable for use in cutting parallel cigarette rods formed in a twin-track cigarette making machine, and having a plane of substantial symmetry which is intended to lie between, parallel to and equidistant from the two rods, the main portions of the ledger support members and their associated cranks being substantially mirror images of one another about the said plane.

* * * * *